US010007214B2

(12) United States Patent
Kamo et al.

(10) Patent No.: US 10,007,214 B2
(45) Date of Patent: Jun. 26, 2018

(54) IMAGE FORMING APPARATUS HAVING FIXING DEVICE AND CAPABLE OF INHIBITING SHEET FROM GETTING WRINKLED

(71) Applicant: BROTHER KOGYO KABUSHIKI KAISHA, Nagoya, Aichi (JP)

(72) Inventors: Masahiko Kamo, Chita (JP); Kei Ishida, Inuyama (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days. days.

(21) Appl. No.: 15/470,242

(22) Filed: Mar. 27, 2017

(65) Prior Publication Data

US 2017/0363997 A1 Dec. 21, 2017

(30) Foreign Application Priority Data

Jun. 16, 2016 (JP) ..... 2016-119781

(51) Int. Cl.
*G03G 15/20* (2006.01)

(52) U.S. Cl.
CPC ..... *G03G 15/2028* (2013.01); *G03G 15/2039* (2013.01)

(58) Field of Classification Search
CPC ..... G03G 15/2028; G03G 15/2039
USPC ..... 399/68
See application file for complete search history.

(56) References Cited

U.S. PATENT DOCUMENTS

| | | | | |
|---|---|---|---|---|
| 5,280,155 | A | 6/1994 | Ohtsuka et al. | |
| 6,108,500 | A * | 8/2000 | Ohkama | G03G 15/2064 399/67 |
| 6,381,422 | B1 * | 4/2002 | Tanaka | G03G 15/2064 399/389 |
| 2004/0190924 | A1 * | 9/2004 | Iwasaki | G03G 15/657 399/68 |
| 2011/0222875 | A1 | 9/2011 | Imada et al. | |
| 2011/0318074 | A1 * | 12/2011 | Hiramatsu | G03G 15/2007 399/329 |

(Continued)

FOREIGN PATENT DOCUMENTS

| | | | |
|---|---|---|---|
| JP | H0527625 | A | 2/1993 |
| JP | 2011191520 | A | 9/2011 |
| JP | 2015219344 | A | 12/2015 |

*Primary Examiner* — Quana M Grainger
(74) *Attorney, Agent, or Firm* — Scully, Scott, Murphy & Presser, P.C.

(57) ABSTRACT

An image forming apparatus includes a conveying device; a fixing device; and a controller. The controller is configured to perform: in response to determining that a first condition is met, starting sheet conveyance by the sheet conveying device upon expiration of a first predetermined period of time starting from receipt of a print instruction; and in response to determining that a second condition different from the first condition is met, starting sheet conveyance by the sheet conveying device at selective one of a first timing and a second timing. The second timing is selected upon determination that an accumulated amount of usage of the fixing device is not greater than a predetermined amount. The first timing is a timing at which a sensed temperature has reached a first threshold value. The second timing is a timing at which a second predetermine period of time has expired after the first timing.

20 Claims, 11 Drawing Sheets

(56) References Cited

U.S. PATENT DOCUMENTS

| | | | | |
|---|---|---|---|---|
| 2013/0136481 | A1* | 5/2013 | Kaida | G03G 15/205 399/70 |
| 2015/0093136 | A1* | 4/2015 | Koda | G03G 15/2039 399/68 |
| 2015/0331370 | A1 | 11/2015 | Nagata | |

* cited by examiner

FIG. 11

351

| CUMULATIVE ROTATION TIME | DELAY TIME |
|---|---|
| 0 ~ r1 | d5 |
| r 1 ~ r2 | d4 |
| r2 ~ r3 | d3 |
| r3 ~ r4 | d2 |
| r4 ~ TIME THRESHOLD | d1 |

IMAGE FORMING APPARATUS HAVING FIXING DEVICE AND CAPABLE OF INHIBITING SHEET FROM GETTING WRINKLED

CROSS REFERENCE TO RELATED APPLICATION

This application claims priority from Japanese Patent Application No. 2016-119781 on Jun. 16, 2016. The entire content of the priority application is incorporated herein by reference.

TECHNICAL FIELD

The present disclosure relates to an image forming apparatus having a fixing device and a method of controlling the image forming apparatus.

BACKGROUND

Conventionally, an image forming apparatus that forms an image by an electro-photographic system is provided with a fixing device for thermally fixing a toner image formed on a sheet of paper. Such a fixing device is known to include a belt heated by a heater, a nip member disposed inside a loop of the belt, and a pressure roller that forms a nip by nipping the belt between itself and the nip member, as disclosed in Japanese Patent Application Publication No. H05-27625, for example.

SUMMARY

In the image forming apparatus provided with the fixing device described above, time duration after the start of temperature control for a heating roller which is a heating-side rotating member until the surface temperature thereof reaches a target temperature varies depending on the initial temperature of the heating roller, an ambient temperature, an output of the heater, or the like. Thus, there is known an image forming apparatus having a first mode in which a sheet is picked up earlier and a second mode in which a sheet is picked up later than in the first mode. In this configuration, when it is assumed that the surface temperature of the heating roller reaches the target temperature within predetermined duration of time, the image forming apparatus operates in the first mode, while when it is highly likely that the surface temperature of the heating roller does not reach the target temperature within the predetermined duration of time, the image forming apparatus operates in the second mode. When the image forming apparatus operates in the second mode, the heating roller may be excessively heated to a temperature above the target temperature before the first sheet arrives at the fixing device. As a result, heat more than necessary may be transmitted to the first sheet. In this case, thermal expansion of the first sheet is increased to make the sheet easier get wrinkled.

Even in the image forming apparatus having the problem as described above, when an adequate pressure is applied to the nip of the fixing device, the sheet is inhibited from getting wrinkled. The fixing device is designed such that a pressure roller which is a pressurizing-side rotating member is thermally expanded with an increase in the temperature of the heating roller, so as to be deformed into an appropriate shape, allowing the nip to be adequately pressurized. However, when the fixing device is in a condition like a new one, an elastic layer constituting the pressure roller tends to be hard. Therefore, adequate thermal expansion does not easily occur, which requires a long time until an adequate pressure is applied to the nip. As a result, it is difficult to promptly obtain the effect of inhibiting the sheet from getting wrinkled.

In view of the foregoing, it is an object of the disclosure to provide a technique applicable to an image forming apparatus provided with a fixing device and capable of inhibiting sheets from getting wrinkled.

In order to attain the above and other objects, the present disclosure provides an image forming apparatus includes a conveying device; a fixing device; and a controller. The conveying device is configured to covey a sheet. The fixing device includes a heater; a temperature sensor; a first rotation member; and a second rotation member. A nip portion is provided between the first rotation member and the second rotation member. The temperature sensor is configured to sense a temperature of the nip portion and output a temperature signal indicating the sensed temperature. The fixing device is configured to thermally fix developer on the sheet conveyed by the conveying device. The controller is configured to perform: in response to a print instruction, determining whether a first condition is met or a second condition different from the first condition is met; in response to determining that the first condition is met, starting sheet conveyance by the sheet conveying device upon expiration of a first predetermined period of time starting from receipt of the print instruction; and in response to determining that the second condition is met, starting sheet conveyance by the sheet conveying device at selective one of a first timing and a second timing, the second timing being selected upon determination as to whether an accumulated amount of usage of the fixing device is greater than a predetermined amount results in that the accumulated amount of usage of the fixing device is not greater than the predetermined amount. The first timing is a timing at which the sensed temperature indicated by the temperature signal has reached a first threshold value. The second timing is a timing at which a second predetermine period of time has expired after the first timing.

According to another aspect, the present disclosure provides a method of controlling sheet conveyance in an image forming apparatus. The image forming apparatus includes: a conveying device; and a fixing device. The conveying device is configured to covey a sheet. The fixing device includes: a heater; a temperature sensor; a first rotation member; and a second rotation member. A nip portion is provided between the first rotation member and the second rotation member. The temperature sensor is configured to sense a temperature of the nip portion and output a temperature signal indicating the sensed temperature. The fixing device is configured to thermally fix developer on the sheet conveyed by the conveying device. The method includes: in response to a print instruction, determining whether a first condition is met or a second condition different from the first condition is met; in response to determining that the first condition is met, starting sheet conveyance by the sheet conveying device upon expiration of a first predetermined period of time starting from receipt of the print instruction; and in response to determining that the second condition is met, starting sheet conveyance by the sheet conveying device at selective one of a first timing and a second timing, the second timing being selected upon determination as to whether an accumulated amount of usage of the fixing device is greater than a predetermined amount results in that the accumulated amount of usage of the fixing device is not greater than the predetermined amount. The first timing is a timing at which the sensed temperature indicated by the temperature signal has reached a first threshold value. The second timing is a timing at which a second predetermine period of time has expired after the first timing.

BRIEF DESCRIPTION OF THE DRAWINGS

The particular features and advantages of the disclosure as well as other objects will become apparent from the following description taken in connection with the accompanying drawings, in which:

FIG. 11 is a diagram showing an example of a delay time table indicating a relationship between cumulative rotation time and delay time.

DETAILED DESCRIPTION

Figure 1:
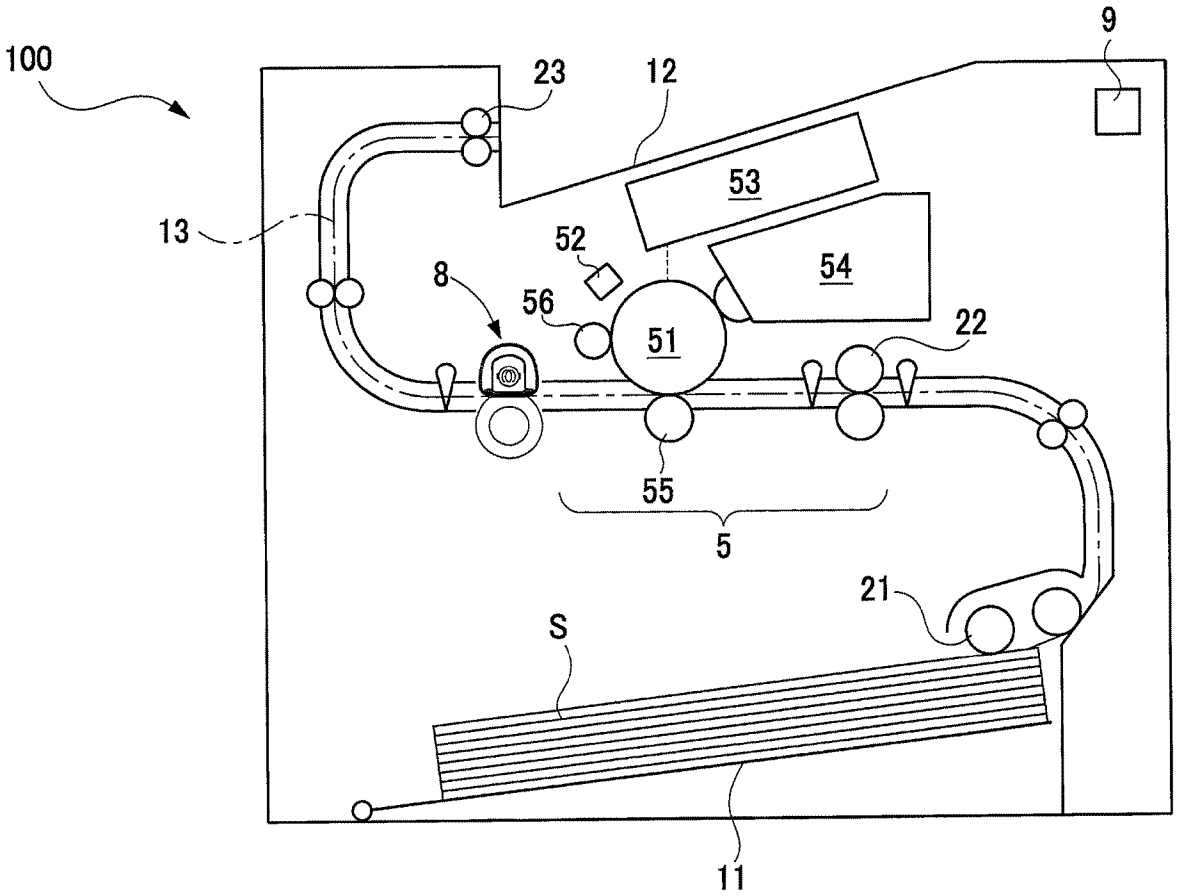
FIG. 1 is a central cross-sectional view illustrating a schematic structure of a printer according to an embodiment of the present disclosure.

Hereinafter, an embodiment of an image forming apparatus according to the present disclosure will be described in detail while referring to the accompanying drawings wherein like parts and components are designated by the same reference numerals to avoid duplicating description. The present embodiment is obtained by applying the present disclosure to a printer having an electro-photographic image forming function.

As illustrated in FIG. 1, a printer 100 according to the present embodiment includes a feed tray 11, a discharge tray 12, a process unit 5, and a fixing unit 8. The feed tray 11 accommodates sheets S before printing. The discharge tray 12 accommodates sheets S after printing. The process unit 5 forms a toner image onto a sheet S of paper. The fixing unit 8 fixes the toner image onto the sheet S.

In the printer 100, as illustrated in FIG. 1, a sheet conveying path 13, which is a conveying path for the sheets S, is formed from the feed tray 11 to the discharge tray 12 via the process unit 5 and the fixing unit 8. The printer 10 has various conveying members for conveying the sheets S along the sheet conveying path 13.

As the conveying members for conveying the sheets S, the printer 100 has, for example, a pickup roller 21, a registration roller 22, and a discharge roller 23 as illustrated in FIG. 1. The pickup roller 21 is driven to rotate by a pickup motor 25 (see FIG. 3), picks up the sheets S one by one from the feed tray 11 and feeds the picked up sheet S to the sheet conveying path 13. The pickup roller 21 and the pickup motor 25 are examples of the claimed conveying device.

Figure 3:
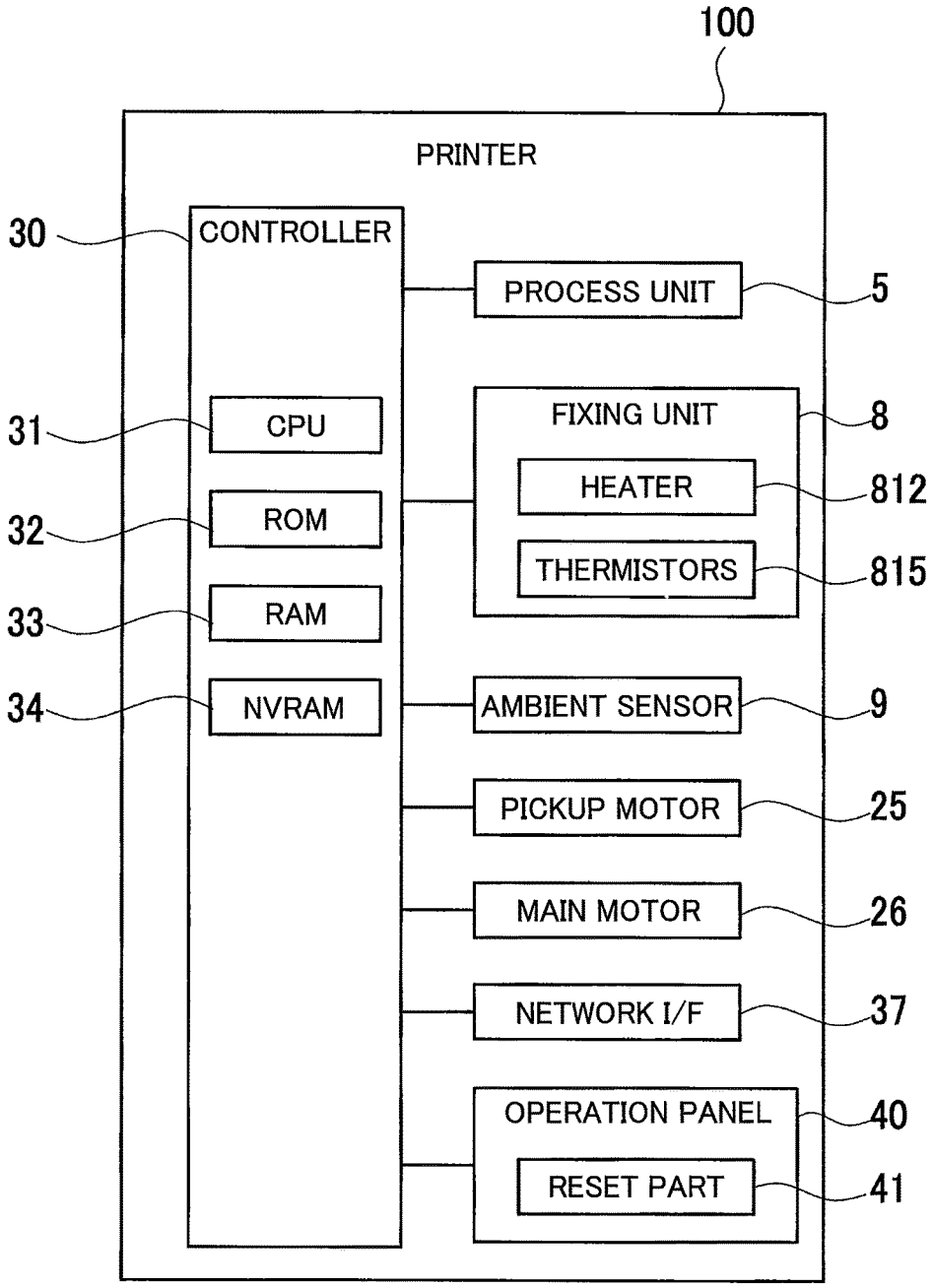
FIG. 3 is a block diagram illustrating an electrical structure of the printer.

The registration roller 22 and the discharge roller 23 are each driven to rotate by, for example, a main motor 26 (see FIG. 3). The registration roller 22 conveys the sheet S picked up by the pickup roller 21 toward the process unit 5 in accordance with the toner image forming operation of the process unit 5. The registration roller 22 may be served as the claimed conveying device. The discharge roller 23 discharges a printed sheet S to the discharge tray 12. The extending direction of the rotation axes of the respective conveying members for conveying the sheets S is parallel to the direction of the rotation axes of respective rotating members of the process unit 5 and the fixing unit 8, and is perpendicular to the paper surface of FIG. 1. Hereinafter, the direction parallel to the above rotation axes is referred to merely as an axial direction.

The process unit 5 forms a toner image on the sheet S conveyed along the sheet conveying path 13 by an electrophotographic system. As illustrated in FIG. 1, the process unit 5 includes a photosensitive body 51, a charging unit 52, an exposing unit 53, a developing unit 54, a transfer unit 55, and a cleaner 56. The photosensitive body 51 is rotated in the clockwise direction in FIG. 1, and the charging unit 52, the exposing unit 53, the developing unit 54, the transfer unit 55, and the cleaner 56 are arranged around the photosensitive body 51 in this order in the rotation direction of the photosensitive body 51.

The charging unit 52 is, for example, a scorotron-type charger, and charges the surface of the photosensitive body 51 substantially uniformly. The exposing unit 53 is, for example, a laser exposing device, and irradiates the photosensitive body 51 with laser light to partially expose the photosensitive body 51 to thereby form an electrostatic latent image according to image data on the photosensitive body 51. The developing unit 54 accommodates toner therein and supplies the toner onto the electrostatic latent image formed on the photosensitive body 51 to develop the toner to thereby form a toner image on the photosensitive body 51. The transfer unit 55 electrically attracts the toner image on the photosensitive body 51 to transfer the toner image onto the sheet S. The cleaner 56 is, for example, a sponge roller, and removes the toner remaining on the photosensitive body 51 after the transfer from the photosensitive body 51.

Figure 2:
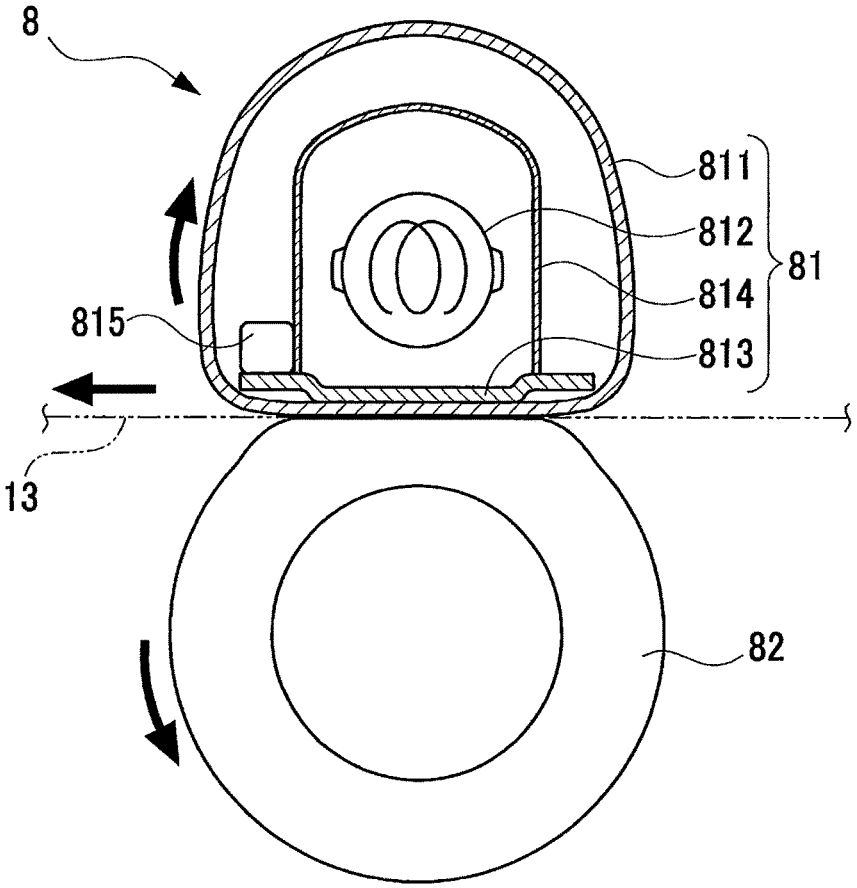
FIG. 2 is a cross-sectional view illustrating a schematic structure of a fixing unit in the printer.

As illustrated in FIG. 2, the fixing unit 8 includes a heating-side member 81 and a pressure roller 82 which are disposed on both sides of the sheet conveying path 13. The heating-side member 81 and the pressure roller 82 closely contact with each other to thereby form a fixing nip therebetween. The fixing unit 8 conveys the sheet S on which the toner image has been formed by the process unit 5 while heating it at the fixing nip to thereby thermally fix the toner image onto the sheet S. The fixing unit 8 is an example of the claimed fixing device.

The heating-side member 81 includes a fixing belt 811, a heater 812, a nip plate 813, a cover member 814, and a thermistor 815. The fixing belt 811 is a cylindrical member having heat resistance and flexibility and extending in the axial direction. The fixing belt 811 is provided so as to be rotatable about its rotation axis extending in the axial direction. The heater 812, the nip plate 813, and the cover member 814 each have substantially the same length in the axial direction as that of the fixing belt 811 and are disposed in an internal space defined by the inner periphery of the fixing belt 811. The fixing belt 811 is an example of the claimed first rotation member, and the heater 812 is an example of the claimed heater.

The heater 812 is a heating member that receives power to produce heat. As the heater 812, for example, a halogen heater, a ceramic heater, or an IH heater (induction heater) can be used. The nip plate 813 is disposed between the fixing belt 811 and the heater 812 and transmits heat from the heater 812 to the fixing belt 811. The nip plate 813 is formed of a metal having high heat conductivity, such as aluminum. The cover member 814 covers the heater 812 together with the nip plate 813 so as to suppress heat diffusion.

The thermistors 815 are used for estimating the temperature of the fixing nip. Each thermistor 815 is positioned outside of the cover member 814 and at the internal space of the fixing belt at one or several places in the axial direction so as to be able to detect the temperature of the nip plate 813. Each thermistor 815 outputs signals varied depending on the temperature of the nip plate 813 at which it is disposed. The thermistors 815 may be contact-type thermistors or noncontact-type thermistors. The thermistors 815 are examples of the claimed temperature sensor 815.

The pressure roller 82 is a rubber roller having a heat resistance. For example, the pressure roller 82 is obtained by coating an elastic layer formed of a silicon rubber and a release layer having mold releasability on a metal shaft core. The pressure roller 82 presses against the nip plate 813 with the fixing belt 811 interposed therebetween. Therefore, as illustrated in FIG. 2, the pressure roller 82 is partially compressed to be slightly deformed. The pressure roller 82 is an example of the claimed second rotation member.

When images are formed, the pressure roller 82 is driven to rotate in the counterclockwise direction in FIG. 2, and the fixing belt 811 is rotated following the rotation of the pressure roller 82 in the clockwise direction in FIG. 2. The printer 100 controls power to be supplied to the heater 812 according to output signals from the thermistors 815 in such a way that the temperature of the fixing nip becomes a predetermined fixing temperature.

The elastic layer of the pressure roller 82 is expanded when heat is applied thereto. The thermal expansion of the pressure roller 82 increases a nip pressure of the fixing nip, thereby making a conveying state of the sheet S stable. Further, the elastic layer of the pressure roller 82 is formed into an inverted crown shape in which it is gradually increased in diameter from the center portion thereof toward both end portions in the axial direction. When the pressure roller 82 is thermally expanded, the difference in diameter between the center portion and the both end portions becomes larger. As a result, the conveying force at the both end portions becomes large. That is, in this case, since the pressure roller 82 is thermally expanded, the sheet S is further inhibited from getting wrinkled due to the conveyance of the sheet S.

Further, the printer 100 has, in addition to the thermistors 815, an ambient sensor 9 that outputs signals varied depending on the temperature and the humidity inside the device, as illustrated in FIG. 1. The printer 100 estimates the ambient temperature and the ambient humidity inside the device according to an output signal from the ambient sensor 9. The ambient sensor 9 is disposed at a position apart from the fixing unit 8 inside the printer 100.

The following description will be made about an electrical configuration of the printer 100. As illustrated in FIG. 3, the printer 100 of the present embodiment has a controller 30 including a central processing unit (CPU) 31, a read only memory (ROM) 32, a random access memory (RAM) 33, and a non-volatile random access memory (NVRAM) 34. Further, the printer 100 includes the process unit 5, the fixing unit 8, the ambient sensor 9, the pickup motor 25, the main motor 26, a network interface (network I/F) 37, and an operation panel 40, all of which are electrically connected to the controller 30.

The ROM 32 stores therein firmware serving as a control program for controlling the printer 100, various settings, and initial values. The RAM 33 is used as a work area into which various control programs are loaded or a storage area in which image data is temporarily stored. The NVRAM 34 is used as a storage area in which various setting values and cumulative values are stored.

The CPU 31 controls each component of the printer 100 according to the control program read out from the ROM 32 or signals transmitted from various sensors while storing a result of the control process in the RAM 33 or NVRAM 34. The CPU 31 is an example of the claimed controller. The controller 30 may be served as the claimed controller. The controller 30 illustrated in FIG. 3 is a general term collectively used for hardware, such as the CPU 31, used for controlling the printer 100 and does not always indicate a single hardware actually existing in the printer 100.

The pickup motor 25 drives the pickup roller 21 to rotate. The main motor 26 drives the conveying members other than the pickup roller 21, such as the registration roller 22, rotation members of the process unit 5, and pressure roller 82 of the fixing unit 8 to rotate. The pickup roller 21 may be driven by the main motor 26.

The network IF 37 is hardware for making the printer communicate with a device connected thereto over a network. A communication method used in the network IF 37 may be wireless communication or wired communication. The printer 100 may have communication means for communicating with an external device, such as an USB interface, in addition to the network IF 37.

The operation panel 40 is hardware for displaying a notification to a user and receiving an instruction input through user's operation The operation panel 40 has, for example, a liquid crystal display and a button group including a start key, a stop key, and numeric keys. The printer 100 of the present embodiment has a reset part 41 on the operation panel 40. The reset part 41 detects, in response to user's operation on the operation panel 40, that the pressure roller 82 is replaced with a new one. When user's operation on the operation panel 40 is received, the reset part 41 outputs a reset signal to the controller 30. The reset part 41 may be a mechanical button, a mechanical lever, or an operation part on a touch-panel-type operation screen.

The following description will be made about temperature control for the fixing unit 8 and conveyance control for the sheets S in the printer 100 of the present embodiment. In the present embodiment, the printer 100 starts heating control for the heater 812 upon receipt of a print instruction. The printer 100 controls power to be supplied to the heater 812 so that the temperature of the fixing nip of the fixing unit 8 falls within a temperature range suitable for fixing images. Note that when there is no following print instruction after the current print job, the printer 100 stops power supply to the heater 812. Hereinafter, operation of the printer 100 when the printer 100 receives a print instruction in a state where the printer 100 stops power supply to the heater 812 will be described.

When a print instruction is received, the printer 100 starts conveying the sheets S by coordinating the timing to allow a print job to be started immediately after completion of preparatory operations of the process unit 5 and the fixing unit 8. That is, the printer 100 starts conveying the sheet S in such a way that the leading edge of the first sheet S arrives at the fixing nip of the fixing unit 8 in a short time after the temperature of the fixing unit 8 reaches a fixable temperature. The printer 100 starts conveying the sheet S by starting driving the pickup roller 21. The printer 100 determines a timing to start driving the pickup roller 21 by estimating a timing at which the temperature of the fixing unit 8 reaches the fixable temperature.

Figure 4:
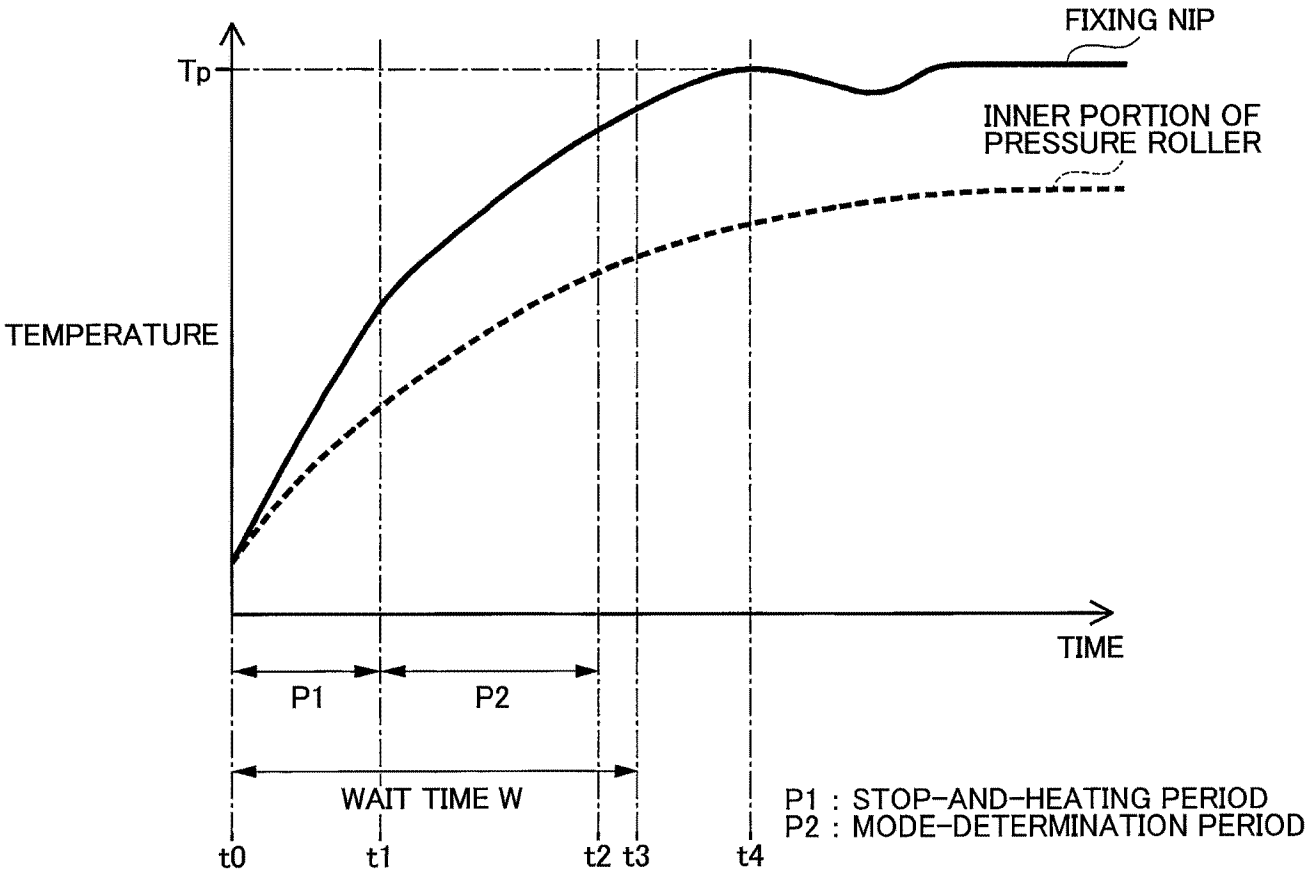
FIG. 4 is an explanatory diagram illustrating an example of a change in temperature of the fixing unit with respect to time passage in a first mode.
Figure 5:
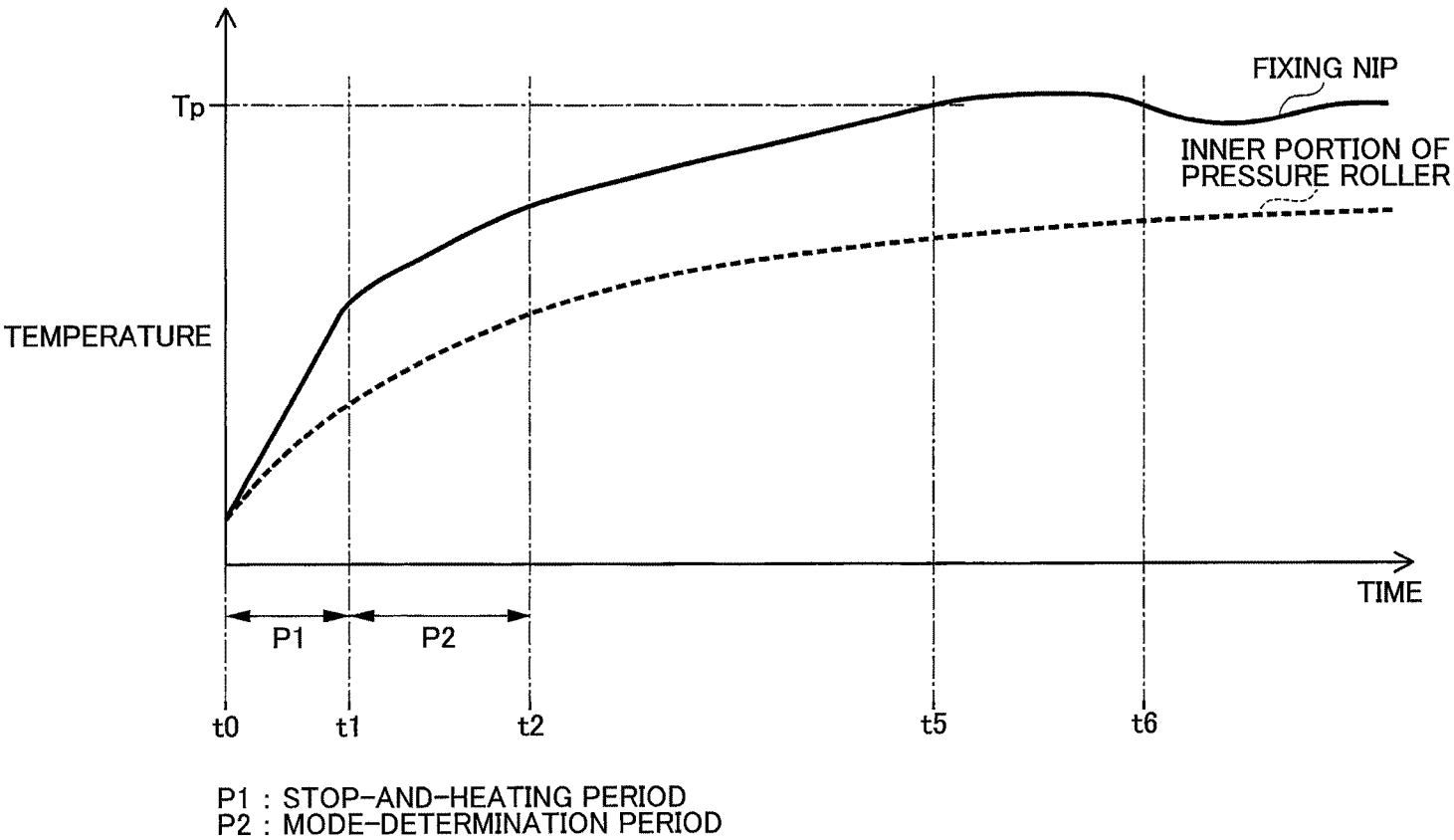
FIG. 5 is an explanatory diagram illustrating an example of a change in temperature of the fixing unit with respect to time passage in a third mode.
Figure 6:
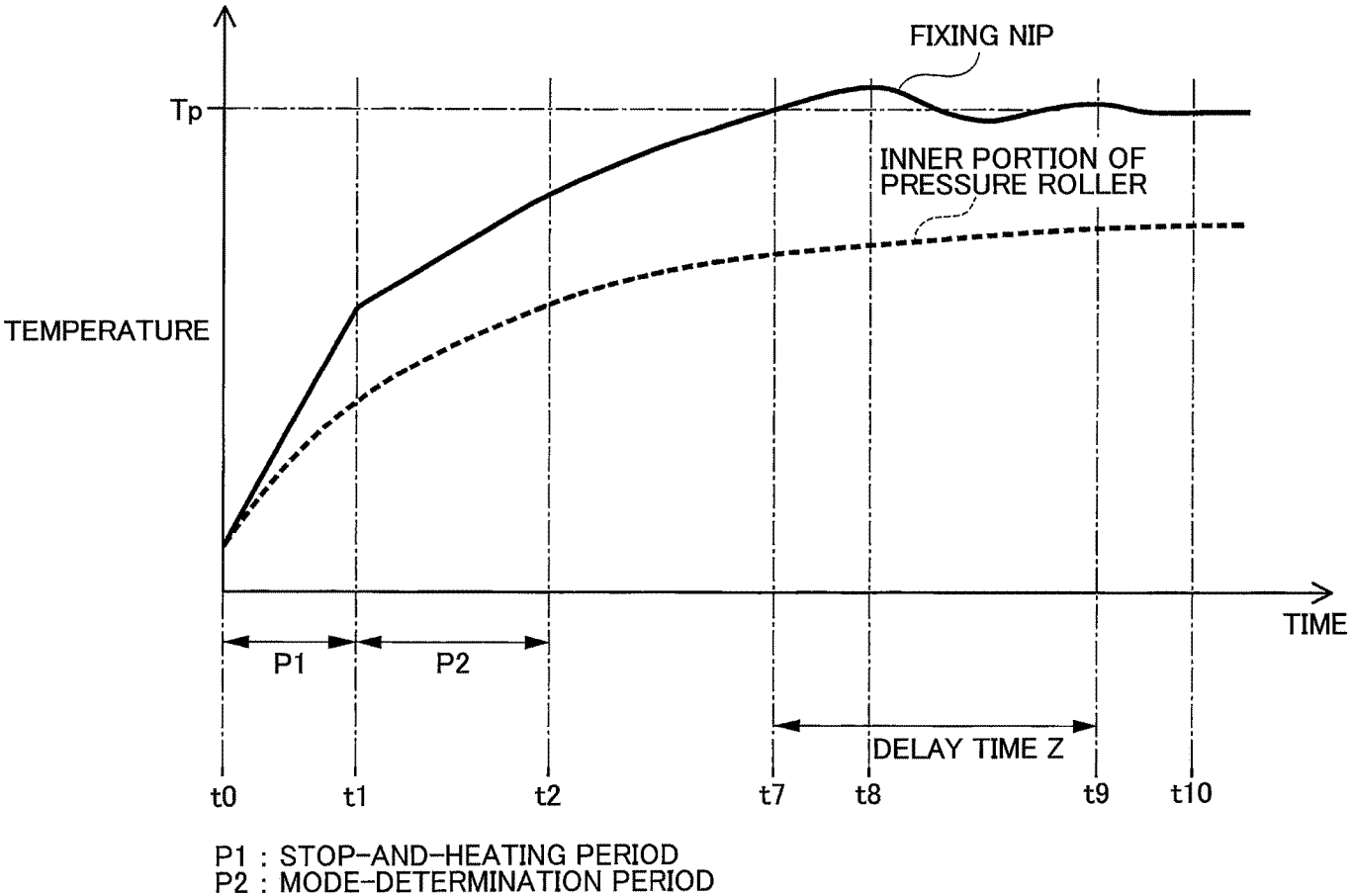
FIG. 6 is an explanatory diagram illustrating an example of a change in temperature of the fixing unit with respect to time passage in a second mode.

The printer 100 has at least three conveyance modes different in timing to pick up the first sheet S when a print instruction is received in a state where heating control for the heater 812 of the fixing unit 8 is not started. A change in temperature of the fixing unit 8 with respect to time passage in each mode is illustrated in FIGS. 4 through 6. In each of FIGS. 4 through 6, a continuous line denotes the temperature of the fixing nip, and a dashed line denotes the internal temperature of the pressure roller 82. As illustrated in FIGS. 4 through 6, the printer 100 starts the heating control for the heater 812 at time t0 by energizing the heater 812 while stopping the pressure roller 82. As a result, the temperature of the fixing nip and the internal temperature of the pressure roller 82 start rising. A period of time during which the heater 812 is energized while the pressure roller 82 is stopped is referred to as a stop-and-heating period P1.

The printer 100 of the present embodiment acquires the temperature of the fixing nip according to output signals from the thermistors 815. Hereinafter, a variation in the acquired temperature of the fixing nip per unit time is defined as a temperature gradient. That is, the temperature gradient is a gradient of a variation in the temperature of the fixing nip of the fixing belt 811. The temperature gradient may be a variation in the level of output signals from the thermistors 815 per unit time.

The printer 100 starts rotating the pressure roller 82 at time t1 after the stop-and-heating period P1 has elapsed from the start of the temperature control with a temperature rise to a certain value. The rotation of the pressure roller 82 transmits the heat of the fixing nip to the pressure roller 82, so that the subsequent temperature gradient becomes smaller than that in the stop-and-heating period P1. The printer 100 acquires, at time t2, a temperature gradient in a period of time from the start of the rotation of the pressure roller 82 to the end of a predetermined mode-determination period P2 (described later).

Then, the printer 100 determines, according to the temperature of the fixing nip at the time when the print instruction is received and the magnitude of the acquired temperature gradient, whether the temperature of the fixing nip can be estimated to reach the fixable temperature within a predetermined preparation time. The printer 100 sets the conveyance mode of the sheet S according to the determination result. The preparation time is, for example, a time required from when the conveyance of the sheet S is started by the pickup roller 21 to when the leading edge of the first sheet S arrives at the fixing nip, and can be estimated from the driving speed of the process unit 5 and the like.

When the temperature gradient is greater than a predetermined first gradient threshold, the printer 100 sets the conveyance mode of the sheet S to the first mode as illustrated in FIG. 4. When the temperature gradient is smaller than a predetermined second gradient threshold, the printer 100 sets the conveyance mode of the sheet S to the third mode as illustrated in FIG. 5. The second gradient threshold is smaller than the first gradient threshold. When the temperature gradient is equal to or smaller than the first gradient threshold and equal to or greater than the second gradient threshold, the printer 100 sets the conveyance mode of the sheet S to the second mode as illustrated in FIG. 6.

The first mode is a mode in which a print job is started in the shortest time. In the first mode, the printer 100 picks up the sheet S at time t3 at which a waiting time W has elapsed from the start of the temperature control, as illustrated in FIG. 4. The waiting time W is the shortest time during which the temperature of the fixing nip is estimated to be an adequate fixing temperature Tp before the sheet S picked up at this timing arrives at the fixing unit 8 and is previously determined by an experiment and the like. The sheet S picked up at time t3 arrives at the fixing nip at time t4. Since the heat of the fixing nip is transmitted to the arrived sheet S, the fixing nip temporarily decreases in temperature. The waiting time is an example of the claimed first predetermined period of time.

The third mode is a mode in which the sheets S are conveyed at a lower speed than in the first mode. When the temperature gradient is small and thus the printer 100 determines that the fixing nip may not increase in temperature sufficiently, the printer 100 reduces the driving speed of the whole device. In the third mode, the printer 100 picks up the sheet S at time t5 at which the temperature of the fixing nip reaches the fixing temperature Tp, as illustrated in FIG. 5. In the third mode, since the sheet S is conveyed at a lower speed than in the first mode, a time required from time t5 at which the sheet S is picked up to time t6 at which the picked up sheet S arrives at the fixing nip is longer than that in the first mode.

The second mode is a mode in which a longer time is required for temperature rise than in the first mode, but the conveying speed of the sheets S is not reduced. In the second mode, the printer 100 picks up the sheet S at time t7 at which the temperature of the fixing nip reaches the fixing temperature Tp, as illustrated in FIG. 6. The sheet S picked up at time t7 arrives at the fixing nip at time t8. In the second mode, since the conveying speed of the sheets S in the second mode is equal to that in the first mode, a time required from time t7 to time t8 is substantially equal to a time required from time t3 to time t4 in the first mode. The time t7 is an example of the claimed first timing, and the fixing temperature Tp is an example of the claimed first threshold value.

The elastic layer of the pressure roller 82 is hard when the pressure roller 82 is new and gradually becomes soft through repetitive use. A time required for the hard elastic layer to obtain an adequate thermal expansion into the inner portion is longer than that for the soft elastic layer under the same application condition of heat. For example, when the pressure roller 82 is a new one or a substantially new one (i.e., an accumulated amount of usage of the pressure roller 82 is small) and thus the elastic layer of the pressure roller 82 is hard, a longer time is required for the elastic layer to be adequately thermally expanded into the inner periphery to such an extent that an adequate fixing nip can be obtained. That is, when the pressure roller 82 is a new one or in a condition like a new one, there is possibility that a thermal expansion of the inner portion of the pressure roller 82 is insufficient at a timing at which the temperature of the fixing nip reaches the fixable temperature.

Further, in the second mode, the temperature of the fixing nip may overshoot as illustrated in FIG. 6. When the first sheet S goes into the fixing nip being at high temperature due to the overshoot, the temperature of the sheet S is increased to an unnecessarily high temperature, resulting in being deformable. Further, when the thermal expansion of the pressure roller 82 is insufficient at the time, the conveying state of the sheet S becomes unstable, which may cause the sheet S to get wrinkled.

Thus, when the second mode is set as the conveyance mode, the printer 100 of the present embodiment determines whether the accumulated amount of usage of the pressure roller 82 is small. When the printer 100 determines that the accumulated amount of usage of the pressure roller 82 is small, the printer 100 delays the timing to start picking up the sheet S up to time t9 as illustrated in FIG. 6. Specifically, the printer 100 picks up the sheet S after a predetermined delay time Z has elapsed from the time at which the temperature of the fixing nip reaches the fixing temperature Tp. When the timing to start picking up the sheet S is thus delayed, it is highly likely to obtain an adequate thermal expansion into the inner portion of the pressure roller 82 at time t10 at which the sheet S arrives at the fixing nip. Thus, the sheet S is hard to get wrinkled. The time t9 is an example of the claimed second timing, and the predetermined delay time Z is an example of the claimed second predetermined period of time.

On the other hand, even though the second mode is set as the conveyance mode, when the printer 100 determines that the accumulated amount of usage of the pressure roller 82 is not small, the printer 100 does not delay the timing to start picking up the sheet S. Since the elastic layer of the pressure roller 82 becomes gradually soft through repetitive compression and heating processes, a time required for the elastic roller to obtain a sufficient thermal expansion into the inner portion is reduced. It is highly likely that at time t7 illustrated in FIG. 6, the adequate thermal expansion is obtained into the inner portion of the pressure roller 82 that has been sufficiently softened. Thus, even if the temperature of the fixing nip overshoots, the sheet S is hard to get wrinkled.

The following description will be made about a procedure of a heater control process for achieving the above-described heating control for the heater 812 and conveyance control for the sheet S with reference to the flowchart illustrated in FIG. 7. The heater control process is executed by the CPU 31 upon receipt of the print instruction when the temperature control for the fixing unit 8 is not performed in the printer 100.

Figure 8:
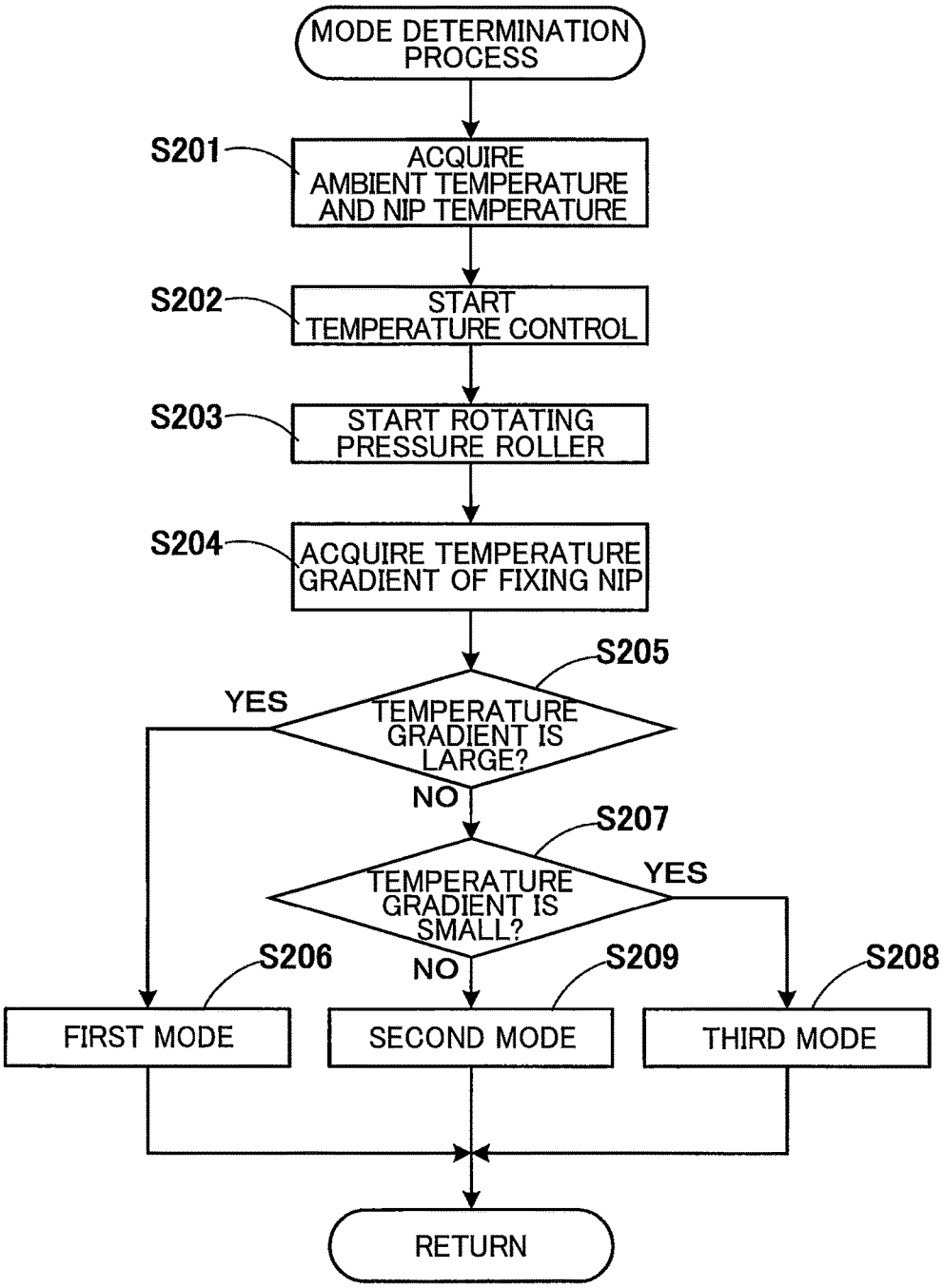
FIG. 8 is a flowchart illustrating steps in a mode determination process executed by the printer.

In the heater control process, in S101 the CPU 31 first executes a mode determination process to set the timing to start picking up the sheet S. A procedure of the mode determination process will be described with reference to the flowchart illustrated in FIG. 8.

In the mode determination process, in S201 the CPU 31 acquires an ambient temperature and a temperature of the fixing nip. The CPU 31 acquires the ambient temperature according to an output signal from the ambient sensor 9, and acquires the temperature of the fixing nip according to output signals from the thermistors 815. In S202 the CPU 31 then starts temperature control for the fixing unit 8 by starting heating control for the heater 812. For example, when the temperature of the fixing nip is lower than the fixing temperature Tp, the CPU 31 energizes the heater 812 to start heating the heater 812 (at time t0 in FIGS. 4 through 6). The pressure roller 82 is not driven to rotate at this point of time.

After the predetermined stop-and-heating period P1 has elapsed from the start of the energization of the heater 812, in S203 the CPU 31 starts rotating the pressure roller 82. In S204 the CPU 31 then continues rotating the pressure roller 82 and energizing the heater 812 (at time t1 in FIGS. 4 through 6) and calculates a temperature gradient of the fixing nip during the mode-determination period P2. The CPU 31 calculates the temperature gradient according to a difference in the temperature of the fixing nip between before and after the mode-determination period P2 and the length of the mode-determination period P2.

In S205 the CPU 31 then determines whether the calculated temperature gradient is sufficiently large. When the ambient temperature is not so low, and the heater 812 has an excellent heating performance, the fixing nip adequately increases in temperature, whereby the temperature gradient becomes sufficiently large. For example, when the calculated temperature gradient is larger than a predetermined first gradient threshold, in S205 the CPU 31 makes an affirmative determination. When the determination is made that the temperature gradient is sufficiently large (S205: YES), in S206 the CPU 31 sets the timing to start picking up the sheet S of the first mode, and ends the mode determination process.

On the other hand, when the calculated temperature gradient is equal to or smaller than the first gradient threshold, in S205 the CPU 31 makes a negative determination. When the determination is made that the temperature gradient is not sufficiently large (S205: NO), in S207 the CPU 31 determines whether the temperature gradient is small. When the ambient temperature is so low, or the heating performance of the heater 812 is deteriorated, the temperature gradient does not become large. For example, when the calculated temperature gradient is smaller than a predetermined second gradient threshold, in S207 the CPU 31 makes an affirmative determination. When the determination is made that the temperature gradient is small (S207: YES), in S208 the CPU 31 sets the timing to start picking up the sheet S of the third mode, and ends the mode determination process. When the third mode is set, the CPU 31 sets the conveying speed of the sheets S to a predetermined value lower than that in the first and second modes.

When the calculated temperature gradient is equal to or larger than the second gradient threshold, in S207 the CPU 31 makes a negative determination. That is, when the determination is made that the temperature gradient is neither large nor small (S207: NO), in S209 the CPU 31 sets the timing to start picking up the sheet S of the second mode, and ends the mode determination process.

Figure 7:
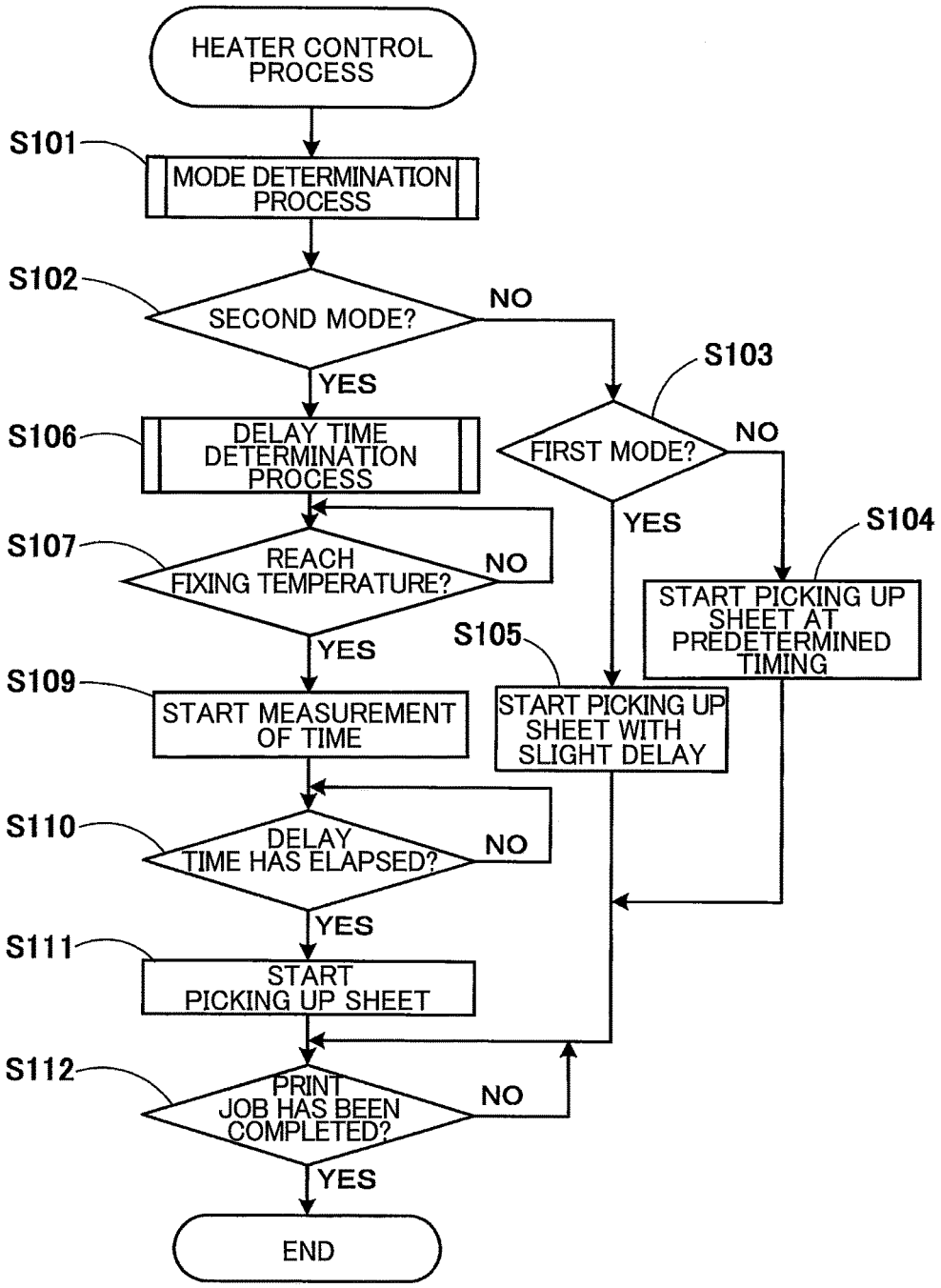
FIG. 7 is a flowchart illustrating steps in a heater control process executed by the printer.

After completing the mode determination process, the CPU 31 returns to the heater control process of FIG. 7. In S102 the CPU 31 determines whether the second mode is set. When the second mode is not set (S102: NO), in S103 the CPU 31 determines whether the first mode is set. When the first mode is not set (S103: NO), that is, when the third mode is set, in S104 the CPU 31 starts picking up the sheet S at the previously determined timing as described above. In the third mode, the CPU 31 determines not to delay the timing to start picking up the sheet S.

Specifically, in the third mode, the CPU 31 starts picking up the sheet S when the temperature of the fixing unit 8 reaches the predetermined fixing temperature Tp (at time t5 of FIG. 5). The conveying speed of the sheets S is lower in the third mode than those in the first and second modes. The lower the conveying speed of the sheet S is, the more stable the conveying state of the sheet S becomes, so that the sheet S is hard to get wrinkled. Therefore, it is preferable not to delay the timing to start picking up the sheet S in the third mode in which the conveying speed of the sheets S is low. The conveying speed of the third mode is an example of the claimed second conveying speed, and conveying speed of the first mode and the conveying speed of the second mode are examples of the claimed first conveying speed.

On the other hand, when the first mode is set (S103: YES), in S105 the CPU 31 starts picking up the sheet S with a very slight delay. The time to delay the timing to start picking up the sheet S in S105 is smaller than the delay time Z in the second mode to be described later, and may be, for example, substantially zero seconds. In the first mode, the printer 100 starts picking up the sheet (at time t3 in FIG. 4) after the predetermined waiting time W has elapsed from the start of the temperature control. Alternatively, the printer 100 starts picking up the sheet S after elapse of a time obtained by adding a slight delay time to the waiting time W. In the first mode, the overshoot of the temperature of the fixing nip is difficult to occur, so that the sheet S is hard to get wrinkled even without delaying the pickup operation.

On the other hand, when the second mode is set (S102: YES), in S106 the CPU 31 executes a delay time determination process to set the time to delay the pickup operation. A procedure of the delay time determination process will be described with reference to the flowchart illustrated in FIG. 9.

In the delay time determination process, in S301 the CPU 31 reads out cumulative rotation time from the NVRAM 34. The cumulative rotation time is a cumulative value of the rotation time of the pressure roller 82 counted from when the pressure roller 82 is new. While rotating the pressure roller 82, the printer 100 accumulates the rotation time of the pressure roller 82 and stores the cumulative value thereof in the NVRAM 34. The cumulative rotation time of the pressure roller 82 is an example of the claimed accumulated amount of usage of the fixing device.

Figure 10:
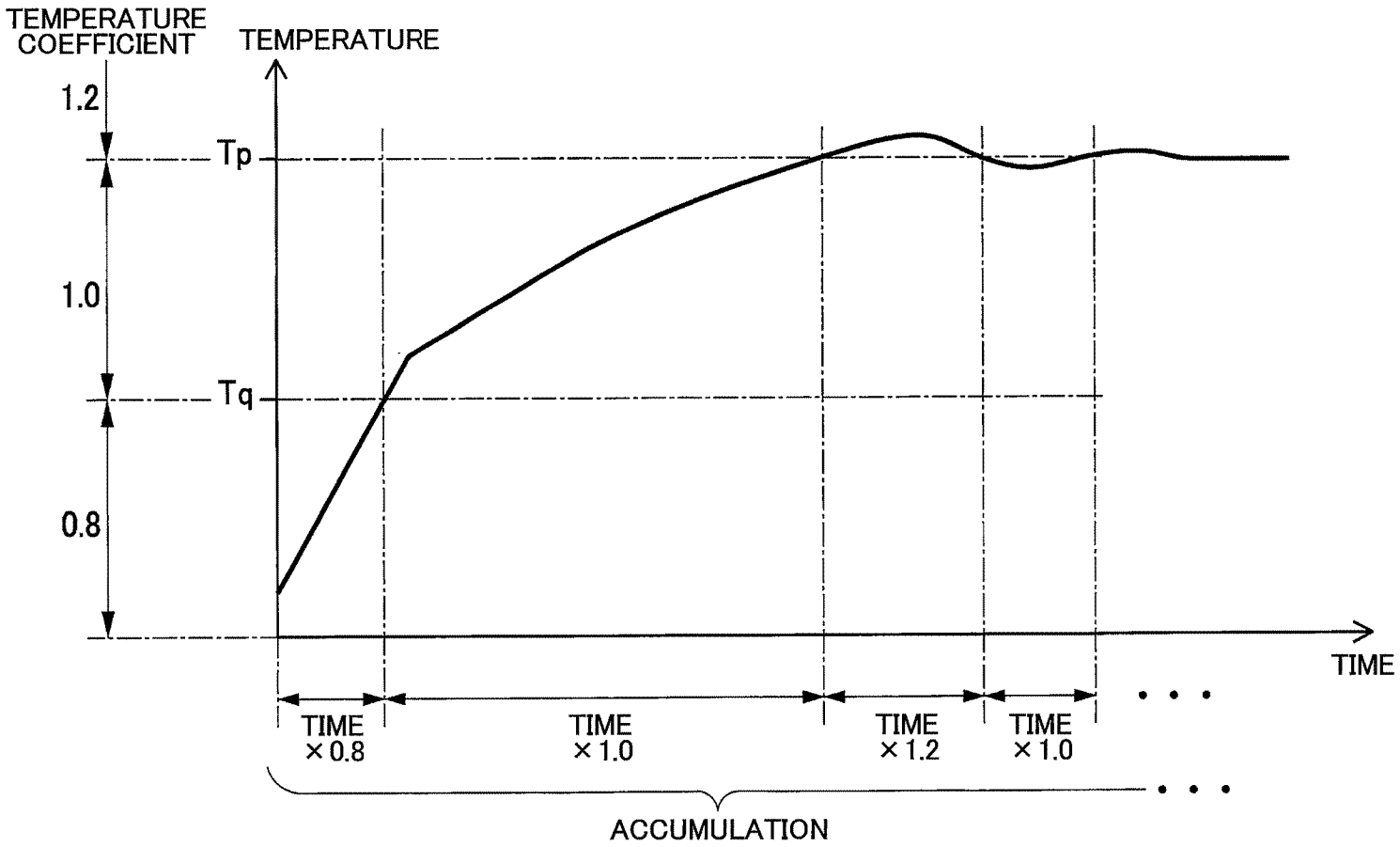
FIG. 10 is an explanatory diagram illustrating an example of a temperature coefficient used in the delay time determination process.

The printer 100 calculates the cumulative value of the rotation time by multiplying the rotation time by a temperature coefficient so that the cumulative value becomes larger as the temperature of the fixing nip is higher. As illustrated in FIG. 10, a temperature coefficient is set in the printer 100, and the temperature coefficient differs in temperature ranges of the fixing nip so as to become larger as the temperature of the fixing nip is increased. In the example of FIG. 10, the temperature coefficient is 0.8 when the temperature of the fixing nip is lower than a temperature Tq which is lower than the fixing temperature Tp, the temperature coefficient is 1.0 when the temperature of the fixing nip is equal to or higher than the temperature Tq and lower than the fixing temperature Tp, and the temperature coefficient is 1.2 when the temperature of the fixing nip is equal to or higher than the fixing temperature Tp.

As illustrated in FIG. 10, the printer 100 accumulates the time obtained by multiplying the rotation time of the pressure roller 82 by the temperature coefficient according to the temperature of the fixing nip to obtain the cumulative rotation time. In the example of FIG. 10, the printer 100 sequentially accumulates a value obtained by multiplying time duration between when the temperature control is started and when the temperature of the fixing nip reaches the temperature Tq by 0.8, time duration between when the temperature of the fixing nip reaches the temperature Tq and when the temperature of the fixing nip reaches the fixing temperature Tp, and a value obtained by multiplying time duration during which the temperature of the fixing nip exceeds the fixing temperature Tp by 1.2. The larger the heat amount received by the pressure roller 82 is, the more easily thermally expanded the pressure roller 82 is. Therefore, a more adequate delay time can be set by calculating the cumulative rotation time according to the temperature of the fixing nip.

Further, the printer 100 stores the cumulative value of the rotation time in the NVRAM 34. When a user operation on the reset part 41 is received, the printer 100 determines that the pressure roller 82 is replaced with a new one. When the CPU 31 receives a reset signal from the reset part 41, the CPU 31 resets the cumulative rotation time stored in the NVRAM 34 to newly accumulate the rotation time.

Figure 9:
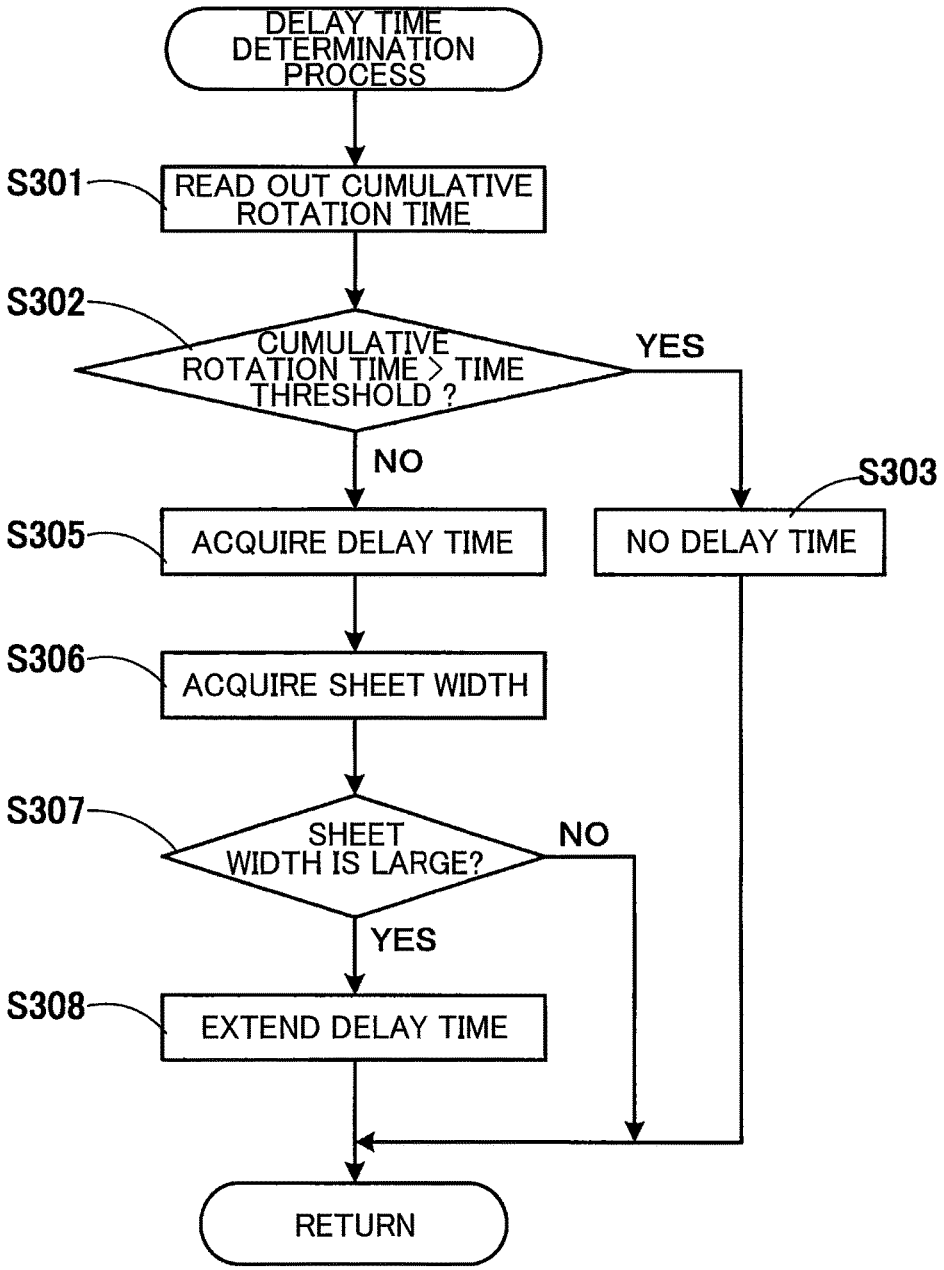
FIG. 9 is a flowchart illustrating steps in a delay time determination process executed by the printer.

Referring back to the flowchart of FIG. 9, in S302 the CPU 31 determines whether the read cumulative rotation time is larger than a predetermined time threshold. The time threshold is an example of the claimed predetermined amount. A time required for the elastic layer of the pressure roller 82 in the printer 100 to be thermally expanded is reduced through repetitive compression and heating processes. The time threshold is the cumulative rotation time of the pressure roller 82 for which a time required to be thermally expanded is estimated to have been reduced. The printer 100 determines the time threshold by an experiment and stores it in the ROM 32 or the NVRAM 34.

When the cumulative rotation time is larger than the time threshold (S302: YES), in S303 the CPU then determines to start picking up the sheet S without delay, and ends the delay time determination process. That is, the delay time is set to zero. When the cumulative rotation time counted from when the pressure roller 82 is new is larger than the time threshold, the elastic layer of the pressure roller 82 is soft. Thus, the sheet S is hard to get wrinkled. In the printer 100, when the cumulative rotation time is larger than the time threshold, the printer 100 starts picking up the sheet S without delay.

On the other hand, when the cumulative rotation time is equal to or smaller than the time threshold (S302: NO), in S305 the CPU 31 acquires a delay time corresponding to the cumulative rotation time. As illustrated in FIG. 11, for example, the printer 100 stores a delay time table 351 indicating the relationship between the cumulative rotation time and the delay time in the NVRAM 34 or ROM 32. The CPU 31 reads out the delay time corresponding to the obtained cumulative rotation time from the delay time table 351.

As illustrated in FIG. 11, in the delay time table 351, for example, the cumulative rotation time from zero to the time threshold is divided into a plurality of ranges (five ranges, in FIG. 11), and delay time values corresponding to the five ranges are stored. In FIG. 11, r1 through r4 and d1 through d5 each denotes a time value, and, inequality expressions "0<r1<r2<r3<r4<time threshold" and "d1<d2<d3<d4<d5" are satisfied. That is, the larger the cumulative rotation time is, the smaller the delay time is. When the cumulative rotation time is large, the sheet S is harder to get wrinkled than when the cumulative rotation time is small. Therefore, it is preferable to reduce the delay time for prioritizing early start of a print job.

In S306 the CPU 31 then acquires a sheet width based on the type of the first sheet S specified in the received print instruction. The sheet width is a length of the sheet S in the direction perpendicular to the conveying direction of the sheet S. In S307 the CPU 31 then determines whether the sheet width of the sheet S is large. The CPU 31 determines that the sheet width is large when the sheet width is larger than a predetermined length threshold. The length threshold is, for example, a length of the short side of A4 size.

When the sheet S has a large sheet width, it is easily influenced by unevenness in pressure of the fixing nip. Thus, the sheet S easily gets wrinkled. That is, the sheet S may get wrinkled at both ends in the width direction thereof even with slight conveyance unevenness. Therefore, it is desirable to start conveying the sheet S after the pressure roller 82 is reliably expanded. Thus, it is preferable to set a longer delay time for the sheet S having a large sheet width than that having a small sheet width.

Thus, when the CPU 31 determines that the sheet width is large (S307: YES), in S308 the CPU 31 extends the delay time acquired in S305, and ends the delay time determination process. For example, the CPU 31 adds a predetermined additional value to the acquired delay time. The additional value may be a fixed value or a value that increases as the sheet width increases. The acquired delay time is an example of the claimed reference time duration, and the time duration indicating a sum of the acquired delay time and the additional value is an example of the claimed extended time duration. On the other hand, when the CPU 31 determines that the sheet width is not large (S307: NO), the CPU 31 does not extend the delay time, and ends the delay time determination process. The un-extended delay time is an example of the claimed shortened time duration.

Easiness of getting wrinkled differs depending on paper quality of the sheet S. Thus, it is more preferable to acquire paper quality as the type of the sheet S and determine the delay time according to the acquired paper quality. For example, the sheet is hard to get wrinkled as the thickness of the sheet is larger. Thus, the delay time may be made smaller for heavy paper than that for plain paper.

Referring back to the flowchart of the heater control process of FIG. 7, after completing the delay time determination process of S106, in S107 the CPU 31 determines whether the temperature of the fixing nip has reached the fixing temperature Tp. When the temperature of the fixing nip has not reached the fixing temperature Tp (S107: NO), the CPU 31 continues heating the fixing unit 8 until the temperature of the fixing nip reaches the fixing temperature Tp.

When the temperature of the fixing nip has reached the fixing temperature Tp (S107: YES), in S109 the CPU 31 starts measurement of time. In S110 the CPU 31 then determines whether the delay time determined in the delay time determination process has elapsed. When the delay time has not elapsed (S110: NO), the CPU 31 waits until the delay time elapses. The CPU 31 performs the temperature control for the fixing unit 8 even during the waiting state.

When the delay time has elapsed (S110: YES), in S111 the CPU 31 start picking up the sheet S. The CPU 31 drives the pickup motor 25 to rotate the pickup roller 21 to thereby pick up one sheet S from the feed tray 11 and start conveyance of the sheet S.

After the processes of S104, S105, or S111, in S112 the CPU 31 determines whether an instructed print job has been completed. When the print job has not been completed (S112: NO), the CPU 31 continues to perform the print job until it is completed. For second and subsequent sheets S, the timing to start picking up the sheet S need not be delayed. The CPU 31 repeatedly picks up the sheets S with a predetermined space between two successive sheets. When the print job has been completed (S112: YES), the CPU 31 ends the heater control process.

As described above in detail, the printer 100 of the present embodiment selects the conveyance mode for controlling the timing to start picking up the sheet S from the plurality of modes. In the first mode, the printer 100 starts picking up the sheet S after the predetermined waiting time W has elapsed from the start of the temperature control. In the second mode, the printer 100 starts picking up the sheet S when the temperature of the fixing nip reaches the fixing temperature Tp. When the printer 100 selects the second mode as the conveyance mode and the cumulative rotation time of the pressure roller 82 does not exceed the time threshold, the timing to start picking up the sheet S is delayed from the timing normally set in the second mode. When the second mode is selected as the conveyance mode and the cumulative rotation time of the pressure roller 82 is small, possibility for the sheet S to get wrinkled is especially increased. Thus, the timing to start picking up the sheet S is delayed so as to ensure a time required for the pressure roller 82 to be thermally expanded. As a result, the pressure roller 82 can be easily expanded adequately before the first sheet S arrives at the fixing unit 8, so that the fixing nip is easy to inhibit the sheets S from getting wrinkled.

When the cumulative rotation time is small, it is highly likely that the pressure roller 82 is not adequately expanded before the timing to start picking up the sheet S even in the first mode. Thus, the sheet S may get wrinkled. However, it is desirable in the first mode to start a print job earlier than in the second mode. Further, it is highly likely that the temperature of the fixing nip does not overshoot in the first mode. Thus, in the first mode, the printer 100 delays the timing to start picking up the sheet S by a shorter time than in the second mode, or does not delay the timing to start picking up the sheet S. As a result, it is highly likely that the printer 100 can inhibit both the sheet S from getting wrinkled and the timing to start a print job from delaying.

While the description has been made in detail with reference to specific embodiment, it would be apparent to those skilled in the art that various changes and modifications may be made thereto. For example the present disclosure can be applied not only to a printer but also to a machine that forms an image by an electro-photographic system such as a multi-function peripheral, a copying machine, a facsimile machine, and the like. In addition, the present disclosure can be applied not only to a monochrome printer but also to a color printer.

In the above embodiment, a member having the fixing belt 811 is used as the fixing unit 8, and the pressure roller 82 is on the driving side. Alternatively, for example, the fixing unit is constituted of a pair of rollers. In this case, a heating-side member may be on the driving side.

Further, although the various timings are determined on the basis of the start time of heating control for the heater 812 in the above embodiment, they may be determined on the basis of the reception time of the print instruction. Further, the timing to start conveying the sheet S is the timing to start picking up the sheet S in the above embodiment. However, when another conveying member that controls the timing to start conveying the sheet S exists between the pickup roller 21 and the fixing unit 8, the timing to start driving the other conveying member may be the timing to start conveying the sheet S. In this case, the timing to start conveying the sheet S may be determined on the basis of a time required to convey the sheet S from the other conveying member to the fixing unit 8.

Further, in the above embodiment, one conveyance mode is determined from among the three conveyance modes according to the temperature gradient after the stop-and-heating period P1, but the mode determination is not limited thereto. For example, when the ambient temperature or the temperature of the fixing nip at the reception time of the print instruction is very low, the third mode may be set as the conveyance mode. Further, when the sheet type is a specific one that is hardly wrinkled, the third mode may be set as the conveyance mode. Examples of the specific type include a heavy paper, a postcard, and an OHP sheet. Further, the conveyance mode may be set in the user setting. Further, the conveyance mode may not include the third mode.

Further, in the second or third mode, the temperature of the fixing nip at which picking up the sheet S is started is not limited to the fixing temperature Tp but may be a temperature lower than the fixing temperature Tp. Further, the temperature of the fixing nip at which picking up the sheet S is started may be different between the second and third modes.

Further, in the above embodiment, the cumulative rotation time which is a cumulative value obtained by multiplying the rotation time by the temperature coefficient depending on the temperature of the fixing nip is used as the cumulative operation amount, but the present disclosure is not limited to this configuration. For example, the temperature coefficient may be determined depending on the temperature of the pressure roller 82, if it can be acquired. Further, the temperature coefficient need not be used. Further, the number of rotations of the pressure roller 82 or the number of printed sheets may be accumulated in place of the rotation time of the pressure roller 82. Further, the accumulation of the rotation time may be stopped after the cumulative rotation time exceeds the time threshold.

Further, the timing to start picking up the sheet S may not be delayed in the first mode. That is, the processes of S103 and S105 in the heater control process may be omitted. Further, even in the third mode, the timing to start picking up the sheet S may be delayed when the pressure roller 82 is new. However, when the timing to start picking up the sheet S is delayed in the first or third mode, it is preferable to set the delay time to a smaller value than the delay time set in the second mode. Since the conveying speed is low in the third mode, the sheet S is hard to get wrinkled. Thus, when the conveyance mode is not the second mode, the delay time to delay the timing to start picking up the sheet S may be smaller than the delay time set in the second mode. For example, a half value of the delay time set in the second mode may be set as the delay time.

Further, although the cumulative rotation time is stored in the NVRAM 34 in the above embodiment, it may be stored in an external device, if any, communicably connected to the printer 100. For example, if the printer 100 is connected to a printer server, the cumulative rotation time may be transmitted to the printer server and stored therein. In this case, when the delay time is to be determined, the cumulative rotation time is acquired from the printer server. Alternatively, the delay time determination process may be executed by the printer server. In this case, the printer 100 receives the determined delay time from the print server.

The processes disclosed in the above embodiment may be performed by a single CPU, a plurality of CPUs, hardware such as an ASIC, or a combination thereof. Further, the processes disclosed in the embodiment can be implemented in various forms such as a non-transitory computer readable storage medium storing programs for performing the processes, or methods of performing the processes.

What is claimed is:

1. An image forming apparatus comprising:

a conveying device configured to convey a sheet;

a fixing device including a heater, a temperature sensor, a first rotation member, and a second rotation member, a nip portion being provided between the first rotation member and the second rotation member, the temperature sensor being configured to sense a temperature of the nip portion and output a temperature signal indicating the sensed temperature, the fixing device being configured to thermally fix developer on the sheet conveyed by the conveying device; and a controller configured to perform:

in response to a print instruction, determining whether a first condition is met or a second condition different from the first condition is met;

in response to determining that the first condition is met, starting sheet conveyance by the sheet conveying device upon expiration of a first predetermined period of time starting from receipt of the print instruction; and in response to determining that the second condition is met:

determining whether an accumulated amount of usage of the fixing device is greater than a predetermined amount, the accumulated amount of usage of the fixing device being an amount of usage from an initial usage to the determination;

in response to determining that the accumulated amount of usage of the fixing device is greater than the predetermined amount, starting sheet conveyance by the sheet conveying device at a first timing; and in response to determining that the accumulated amount of usage of the fixing device is not greater than the predetermined amount, starting sheet conveyance by the sheet conveying device at a second timing, wherein the first timing is a timing at which the sensed temperature indicated by the temperature signal has reached a first threshold value, and wherein the second timing is a timing at which a second predetermined period of time has expired after the first timing.

2. The image forming apparatus according to claim 1, wherein the first condition is that the sensed temperature indicated by the temperature signal is equal to or higher than a second threshold value that is lower than the first threshold value, and the second condition is that the sensed temperature indicated by the temperature signal is smaller than the second threshold value.

3. The image forming apparatus according to claim 1, wherein the first predetermined period of time is divided into a first time duration and a second time duration, the second time duration being shorter than the second predetermined period of time, wherein the second time duration is variable depending upon a type of sheet including a first type sheet and a second type sheet conveyed by the conveying device.

4. The image forming apparatus according to claim 3, wherein the controller is further configured to perform setting, as the second predetermined period of time, an extended time duration longer than a reference time duration for conveyance of the first type sheet having a first width in a direction orthogonal to a conveying direction in which the first type sheet is conveyed by the conveying device and setting, as the second predetermined period of time, a shortened time duration shorter than or equal to the reference time duration for conveyance of the second type sheet having a second width in a direction orthogonal to the conveying direction in which the second type sheet is conveyed by the conveying device.

5. The image forming apparatus according to claim 1, wherein the second predetermined period of time is variable depending upon the accumulated amount of usage of the fixing device, the smaller the accumulated amount of usage of the fixing device is, the longer the second predetermined period of time is.

6. The image forming apparatus according to claim 1, wherein the controller is further configured to adjust the accumulated amount of usage of the fixing device to a greater amount as the sensed temperature indicated by the temperature signal gets higher.

7. The image forming apparatus according to claim 1, wherein sheet conveyance by the sheet conveying device at a first conveying speed is started at the second timing, and sheet conveyance by the sheet conveying device at a second conveying speed slower than the first conveying speed is started at the first timing.

8. The image forming apparatus according to claim 1, wherein the controller is further configured to perform setting, as the second predetermined period of time, an extended time duration longer than a reference time duration for sheet conveyance by the sheet conveying device at a first conveying speed and setting, as the second predetermined period of time, a shortened time duration shorter than or equal to the reference time duration for sheet conveyance by the sheet conveying device at a second conveying speed slower than the first conveying speed.

9. The image forming apparatus according to claim 1, wherein the controller is further configured to perform acquiring a temperature gradient based on the temperature signal in response to the print instruction, wherein the determining determines whether the first condition is met or the second condition is met depending upon the temperature gradient.

10. A method of controlling sheet conveyance in an image forming apparatus including: a conveying device configured to convey a sheet; and a fixing device including a heater, a temperature sensor, a first rotation member, and a second rotation member, a nip portion being provided between the first rotation member and the second rotation member, the temperature sensor being configured to sense a temperature of the nip portion and output a temperature signal indicating the sensed temperature, the fixing device being configured to thermally fix developer on the sheet conveyed by the conveying device, the method comprising:

in response to a print instruction, determining whether a first condition is met or a second condition different from the first condition is met;

in response to determining that the first condition is met, starting sheet conveyance by the sheet conveying device upon expiration of a first predetermined period of time starting from receipt of the print instruction; and in response to determining that the second condition is met:

determining whether an accumulated amount of usage of the fixing device is greater than a predetermined amount, the accumulated amount of usage of the fixing device being an amount of usage from an initial usage to the determination;

in response to determining that the accumulated amount of usage of the fixing device is greater than the predetermined amount, starting sheet conveyance by the sheet conveying device at a first timing; and in response to determining that the accumulated amount of usage of the fixing device is not greater than the predetermined amount, starting sheet conveyance by the sheet conveying device at a second timing, wherein the first timing is a timing at which the sensed temperature indicated by the temperature signal has reached a first threshold value, and wherein the second timing is a timing at which a second predetermined period of time has expired after the first timing.

11. The method according to claim 10, wherein the first condition is that the sensed temperature indicated by the temperature signal is equal to or higher than a second threshold value that is lower than the first threshold value, and the second condition is that the sensed temperature indicated by the temperature signal is smaller than the second threshold value.

12. The method according to claim 10, wherein the first predetermined period of time is divided into a first time duration and a second time duration, the second time duration being shorter than the second predetermined period of time, wherein the second time duration is variable depending upon a type of sheet including a first type sheet and a second type sheet conveyed by the conveying device.

13. The method according to claim 12, further comprising:

setting, as the second predetermined period of time, an extended time duration longer than a reference time duration for conveyance of the first type sheet having a first width in a direction orthogonal to a conveying direction in which the first type sheet is conveyed by the conveying device and setting, as the second predetermined period of time, a shortened time duration shorter than or equal to the reference time duration for conveyance of the second type sheet having a second width in a direction orthogonal to the conveying direction in which the second type sheet is conveyed by the conveying device.

14. The method according to claim 10, wherein the second predetermined period of time is variable depending upon the accumulated amount of usage of the fixing device, the smaller the accumulated amount of usage of the fixing device is, the longer the second predetermined period of time is.

15. The method according to claim 10, further comprising:

adjusting the accumulated amount of usage of the fixing device to a greater amount as the sensed temperature indicated by the temperature signal gets higher.

16. The method according to claim 10, wherein sheet conveyance by the sheet conveying device at a first conveying speed is started at the second timing, and sheet conveyance by the sheet conveying device at a second conveying speed slower than the first conveying speed is started at the first timing.

17. The method according to claim 10, further comprising:

setting, as the second predetermined period of time, an extended time duration longer than a reference time duration for sheet conveyance by the sheet conveying device at a first conveying speed and setting, as the second predetermined period of time, a shortened time duration shorter than or equal to the reference time duration for sheet conveyance by the sheet conveying device at a second conveying speed slower than the first conveying speed.

18. The method according to claim 10, further comprising:

acquiring a temperature gradient based on the temperature signal in response to the print instruction, wherein the determining determines whether the first condition is met or the second condition is met depending upon the temperature gradient.

19. A non-transitory computer readable storage medium storing a set of program instructions for controlling sheet conveyance in an image forming apparatus including: a conveying device configured to convey a sheet; a fixing device including a heater, a temperature sensor, a first rotation member, and a second rotation member, a nip portion being provided between the first rotation member and the second rotation member, the temperature sensor being configured to sense a temperature of the nip portion and output a temperature signal indicating the sensed temperature, the fixing device being configured to thermally fix developer on the sheet conveyed by the conveying device; and a controller, the set of program instructions, when executed by the controller, causing the image forming apparatus to perform:

in response to a print instruction, determining whether a first condition is met or a second condition different from the first condition is met;

in response to determining that the first condition is met, starting sheet conveyance by the sheet conveying device upon expiration of a first predetermined period of time starting from receipt of the print instruction; and in response to determining that the second condition is met determining whether an accumulated amount of usage of the fixing device is greater than a predetermined amount, the accumulated amount of usage of the fixing device being an amount of usage from an initial usage to the determination;

in response to determining that the accumulated amount of usage of the fixing device is greater than the predetermined amount, starting sheet conveyance by the sheet conveying device at a first timing; and in response to determining that the accumulated amount of usage of the fixing device is not greater than the predetermined amount, starting sheet conveyance by the sheet conveying device at a second timing, wherein the first timing is a timing at which the sensed temperature indicated by the temperature signal has reached a first threshold value, and wherein the second timing is a timing at which a second predetermined period of time has expired after the first timing.

20. The image forming apparatus according to claim 1, wherein the accumulated amount of usage of the fixing device is selected from a group consisting of number of rotations of one of the first rotation member or the second rotation member, number of sheets printed and rotation time of one of the first rotation member or the second rotation member.

* * * * *